US012757982B2

(12) United States Patent
Sheng et al.

(10) Patent No.: US 12,757,982 B2
(45) Date of Patent: Oct. 13, 2026

(54) CLIP-ON STRAP ASSEMBLY AND WRISTWATCH INCLUDING THE SAME

(71) Applicant: Jiangyu Kangjian Innovation Medical Technology(Chengdu) Co., Ltd, Chengdu (CN)

(72) Inventors: Ying-Wei Sheng, New Taipei (TW); Chieh Kuo, New Taipei (TW); Dai-Hong Cai, Shenzhen (CN)

(73) Assignee: Jiangyu Kangjian Innovation Medical Technology(Chengdu) Co., Ltd, Chengdu (CN)

( * ) Notice: Subject to any disclaimer, the term of this patent is extended or adjusted under 35 U.S.C. 154(b) by 1093 days.

(21) Appl. No.: 17/841,939

(22) Filed: Jun. 16, 2022

(65) Prior Publication Data

US 2023/0000218 A1 Jan. 5, 2023

(30) Foreign Application Priority Data

Jul. 1, 2021 (CN) ..... 202121486927.2

(51) Int. Cl.
*A44C 5/14* (2006.01)

(52) U.S. Cl.
CPC ..... *A44C 5/14* (2013.01)

(58) Field of Classification Search
CPC ..... A44C 5/14; A44C 5/147
See application file for complete search history.

(56) References Cited

U.S. PATENT DOCUMENTS

| | | | | |
|---|---|---|---|---|
| 7,249,398 | B2 * | 7/2007 | Roy | A44C 5/147 24/265 B |
| 2006/0162132 | A1 * | 7/2006 | Roy | G04B 37/1486 24/71 J |
| 2017/0181510 | A1 * | 6/2017 | Novak | A44C 15/0025 |
| 2019/0058288 | A1 * | 2/2019 | Sakaizawa | H01R 13/639 |
| 2020/0154835 | A1 * | 5/2020 | Chen | A44C 5/147 |

* cited by examiner

*Primary Examiner* — Phuong K Dinh
(74) *Attorney, Agent, or Firm* — ScienBiziP, P.C.

(57) ABSTRACT

A clip-on strap assembly includes a watch strap with a groove and two mounting holes, a base disposed in the groove and including a midpoint connecting portion, two movable members movably on the base and located on opposite sides of the connecting portion, two snap hooks disposed on ends of the movable members, two elastic members disposed between the movable members and the connecting portion, and two pressing members disposed on the movable members and accommodated in the two mounting holes. The pressing members can bear against the elastic members. The snap hooks can engage with or be disengaged from the two buckles. The watch strap is clipped to or unclipped from the watch head merely by only pressing the two pressing members, facilitating the replacement of the watch strap.

15 Claims, 6 Drawing Sheets

CLIP-ON STRAP ASSEMBLY AND WRISTWATCH INCLUDING THE SAME

FIELD

The subject matter herein generally relates to wearable devices, and more particularly to a clip-on strap assembly and a wristwatch including the clip-on strap assembly.

BACKGROUND

At present, when replacing a strap of a watch, one must first remove the strap from one hand by disengaging the strap from a buckle, and to put the watch on again, then thread the strap through the buckle to secure it.

BRIEF DESCRIPTION OF THE DRAWINGS

Implementations of the present disclosure will now be described, by way of embodiments, with reference to the attached figures.

DETAILED DESCRIPTION

Figure 1:
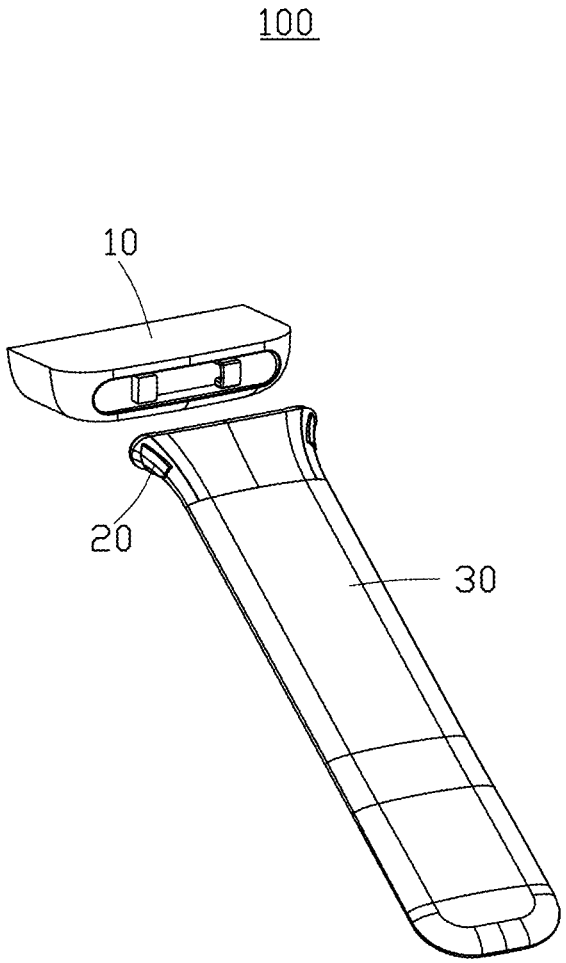
FIG. 1 is a schematic diagram of a wristwatch according to an embodiment of the present disclosure.

The present disclosure will now be described more fully hereinafter with reference to the accompanying drawings, in which exemplary embodiments of the disclosure are shown. This disclosure may, however, be embodied in many different forms and should not be construed as limited to the exemplary embodiments set forth herein. Rather, these exemplary embodiments are provided so that this disclosure will be thorough and complete, and will fully convey the scope of the disclosure to those skilled in the art. Like reference numerals refer to like elements throughout.

As used herein, when a first component is referred to as "installed" to second component, it is intended that the first component may be directly installed to the second component or may be indirectly installed to the second component via a third component between them. When a first component is referred to as "disposed to" a second component, it is intended that the first component may be directly disposed to the second component or may be disposed to the second component via a third component between them.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein. The term "and/or" used herein includes any suitable combination of one or more related items listed.

An embodiment of the present disclosure provides a wristwatch. The wristwatch includes a watch head, two buckles disposed on the watch head, a watch strap, and a locking assembly disposed in the watch strap. The locking assembly includes a base disposed in the watch strap along a width direction of the watch strap and includes a connecting portion located in the middle, two movable members movably disposed on the base and located on opposite sides of the connecting portion, two snap hooks disposed on ends of the two movable members facing the connecting portion, two elastic members, each of the two elastic members being disposed between one of the two movable members and the connecting portion, and two pressing members disposed on ends of the two movable members away from the connecting portion. The two snap hooks can engage with or be disengaged from the two buckles. When the two pressing members are pressed, the two movable members are moved towards each other, to compress the two elastic members, and to cause the two snap hooks to be disengaged from the two buckles. When the two pressing members are released, the two movable members move away from each other by the force of the two elastic members, to cause the two snap hooks to be engaged with the two buckles.

The watch strap is installed on or disassembled from the watch head merely by pressing the two pressing members, without removing the entire wristwatch from a user's hand, facilitating the replacement of the watch strap.

Referring to FIG. 1, an embodiment of a wristwatch 100 is provided. The wristwatch 100 includes a watch head 10 and a strap assembly snap-fittingly connected with the watch head 10. The strap assembly includes a locking assembly 20 and a watch strap 30, the locking assembly 20 is disposed in the watch strap 30 and is used to fix the watch strap 30 on the watch head 10.

Figure 2:
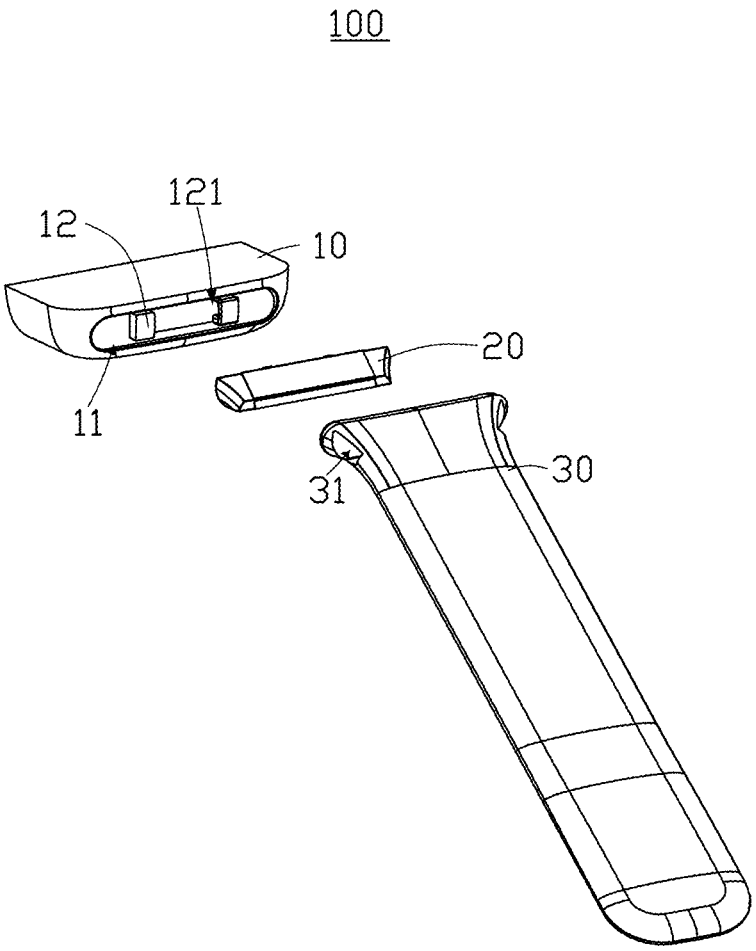
FIG. 2 is an exploded view of the wristwatch according to an embodiment of the present disclosure.

Referring to FIG. 2, a side of the watch head 10 which is connected with the watch strap 30 defines a first groove 11 across a width of the watch strap 30. In other words, the first groove 11 extends along a width direction of the watch strap 30. The first groove 11 is configured to accommodate an end of the watch strap 30. Two buckles 12 are disposed in the first groove 11. The two buckles 12 are arranged along the first groove 11. Each of the two buckles 12 defines a slot 121 for connecting the locking assembly 20.

Figure 3:
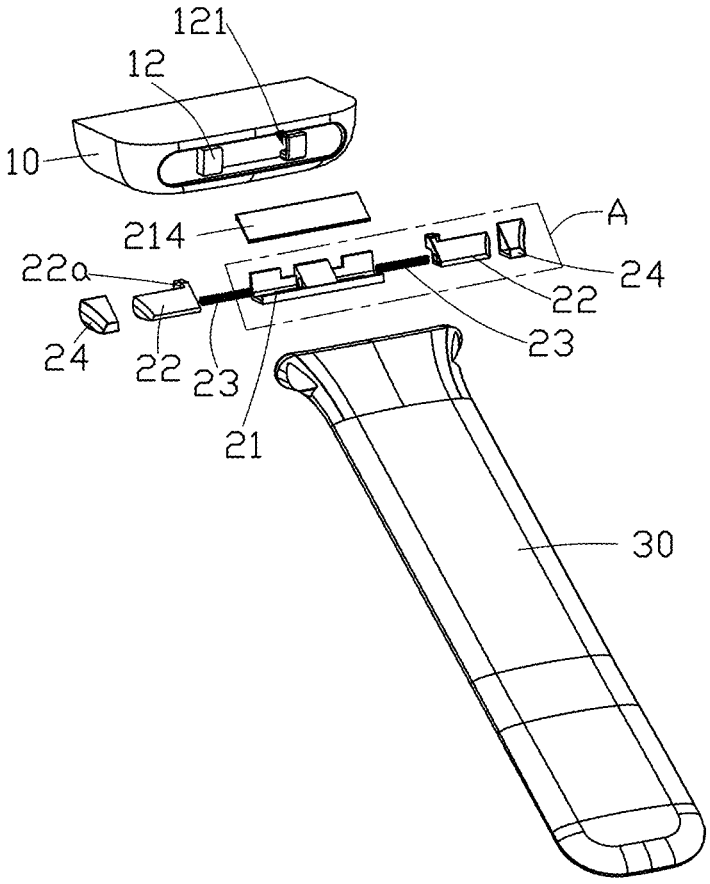
FIG. 3 is an exploded view of a locking assembly of the wristwatch according to an embodiment of the present disclosure.
Figure 4:
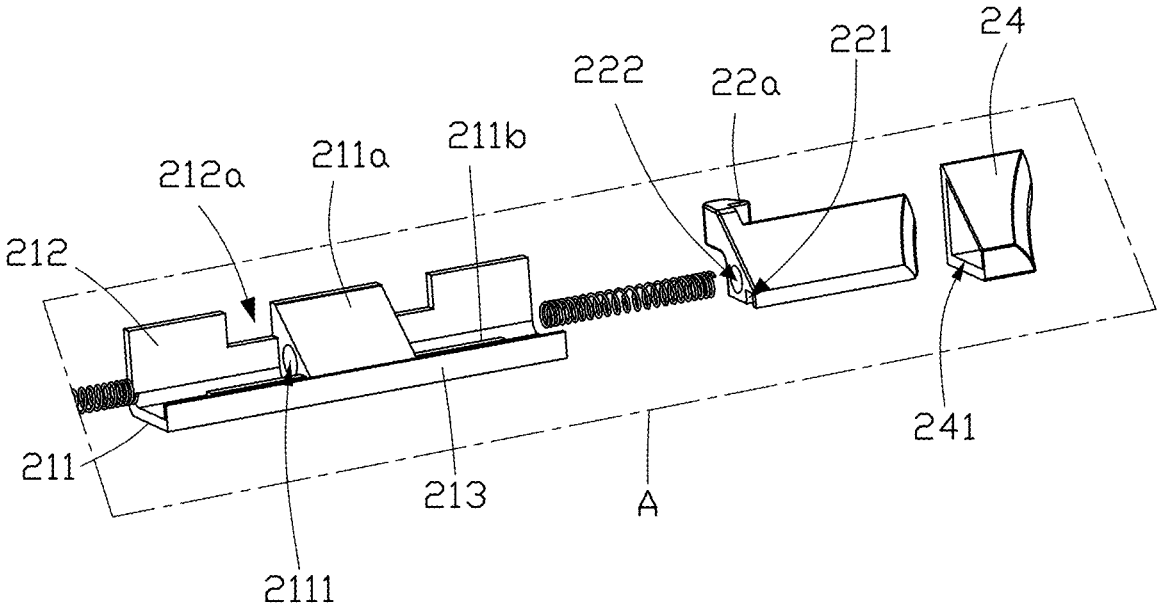
FIG. 4 is an enlarged view of part A from FIG. 3.
Figure 5:
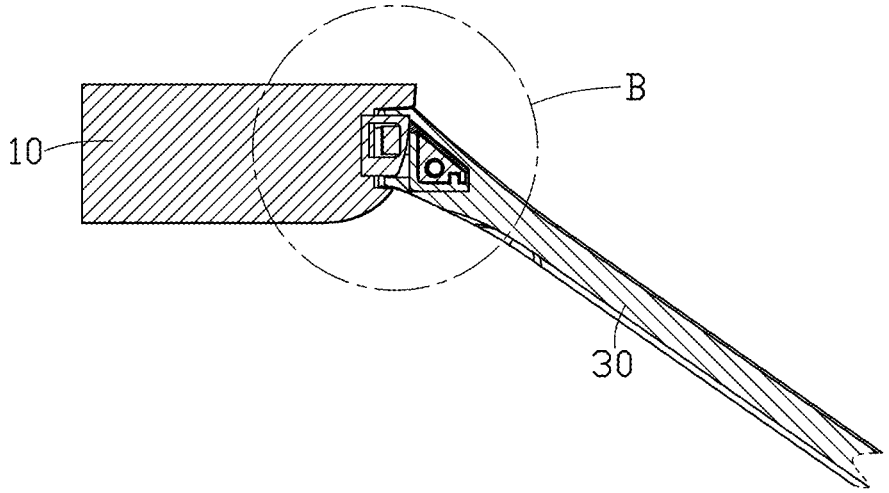
FIG. 5 is a cross-sectional view of the wristwatch according to an embodiment of the present disclosure.
Figure 6:
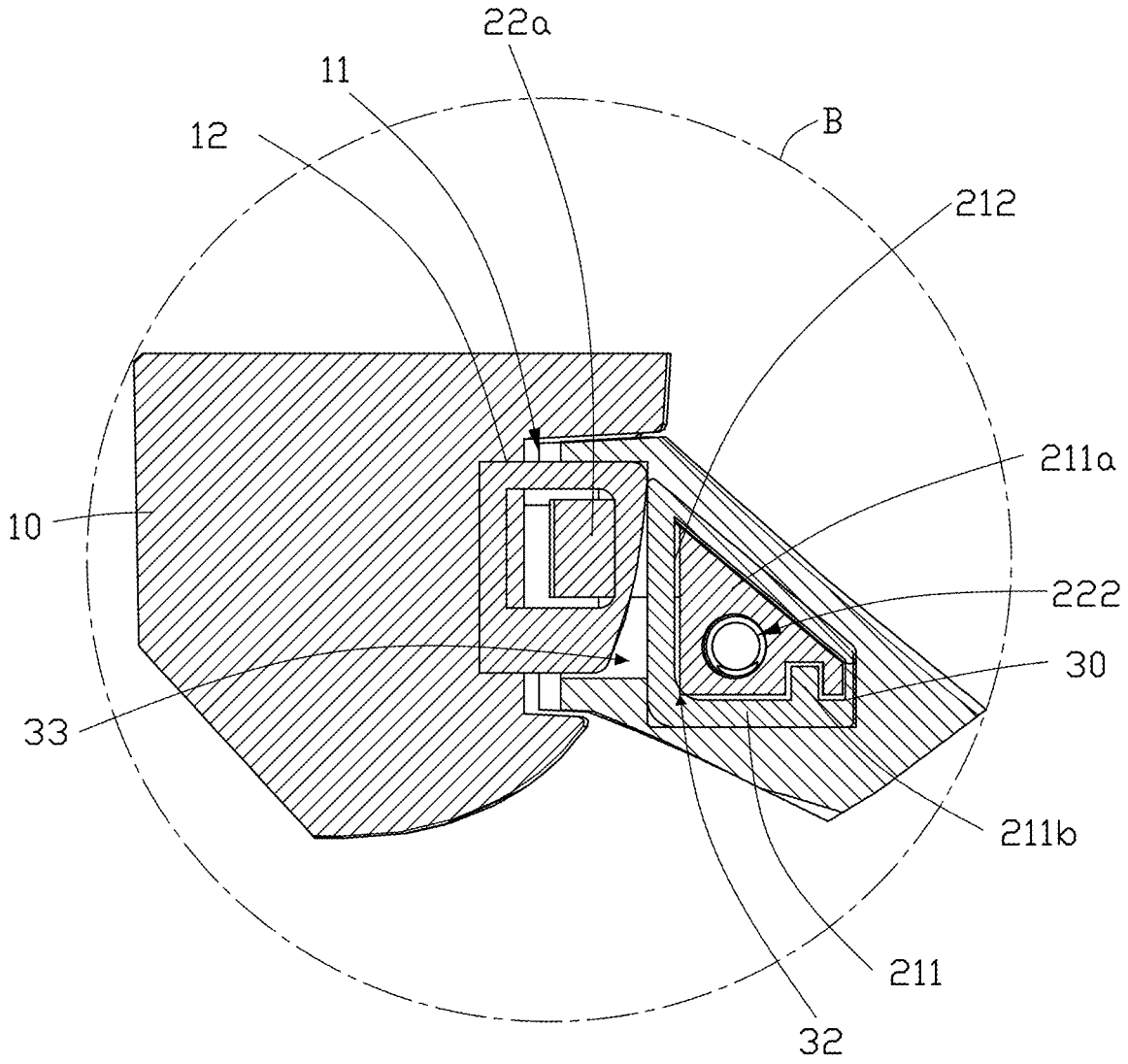
FIG. 6 is an enlarged view of part B from FIG. 5.

Referring to FIG. 3 and FIG. 4, the locking assembly includes a base 21, two movable members 22, two elastic members 23, and two pressing members 24. The base 21 is disposed in the watch strap 30 and is across the watch strap 30. The two movable members 22 are disposed on the base 21. Each elastic member 23 is disposed between one movable member 22 and the base 21. The two pressing members 24 are disposed on ends of the movable members 22 away from the base 21, Each movable member 22 is provided with a snap hook 22*a* which is adapted for engagement with or disengagement from one buckle 12.

Referring to FIGS. 3 to 6, the base 21 includes a first plate 211 and a second plate 212. The first plate 211 is arranged in a horizontal direction, and the second plate 212 is vertically connected to the first plate 211. The first plate 211 is provided with a connecting portion 211*a*, which is located at approximate midpoint of the first plate 211. The first plate 211 is also provided with a flange 211*b*, which extends along a length direction of the first plate 211 for connecting the movable members 22. In one embodiment, the first plate 211 is provided with two flanges 211*b*, an end of each flange 211*b* resists against the connecting portion 211*a*, and other end of each flange 211*b* extends away from the connecting portion 211*a*. In one embodiment, the connecting portion 211*a* defines two accommodation grooves 2111 for accommodating the two elastic members 23.

The second plate 212 defines two openings 212*a*. The two openings 212*a* are on opposite sides of the connecting portion 211*a*, the snap hooks 22*a* of the movable members 22 are disposed in the openings 212*a* and protrude out of the second plate 212. A length of the opening 212*a* in the length direction of the second plate 212 is the distance that the movable members 22 can drive the snap hooks 22*a* to move.

In one embodiment, the base 21 further includes a third plate 213. The third plate 213 is vertically connected to an end of the first plate 211 away from the second plate 212. In other words, the third plate 213 and the second plate 212 are vertically connected to opposite ends of the first plate 211. The third plate 213 is substantially parallel to the second plate 212. A width of the third plate 213 is less than a width of the second plate 212. Surfaces of the first plate 211, the second plate 212, and the third plate 213 are joined and define a concavity for installing and seating the movable members 22, facilitating the positioning of the movable members 22.

In one embodiment, the base 21 further includes a cover plate 214 which is connected with ends of the second plate 212 and the third plate 213 away from the first plate 211. Surfaces of the first plate 211, the second plate 212, the third plate 213, and the cover plate 214 are join and define a moving channel, the cover plate 214 resists against the movable members 22 to limit a horizontal moving direction of the movable members 22 along the moving channel.

A shape of a section of the movable members 22 in a direction perpendicular to the length direction of the first plate 211 is adapted to a shape of a section of the moving channel in the direction perpendicular to the length direction of the first plate. Each of the movable members 22 defines a recess 221 whose profile matches with the flange 211*b*. The flange 211*b* is slidably accommodated in the recess 211 to guide and limit the moving direction of the movable members 22. The movable members 22 are slidably accommodated in the moving channel and slide along a length direction of the flange 211*b*.

An end of each movable member 22 close to the connecting portion 211*a* defines a second accommodation groove 22. The second accommodation groove 22 corresponds to one first accommodation groove 2111. The ends of each elastic member 23 are accommodated in one first accommodation groove 2111 and in one second accommodation groove 22, for a potential restoring force of one movable member 22.

Two snap hooks 22*a* are disposed on two sides of the two movable members 22 away from the third plate 213. The two snap hooks 22*a* face away from each other in the length direction of the first plate 211. The two snap hooks 22*a* are movably disposed in the two openings 212*a* and are moved along the length direction of the base 21 by the movable members 22. A maximum distance between the two snap hooks 22*a* after the two snap hooks 22*a* move away from each other is greater than a distance between the two buckles 12, and a minimum distance between the two snap hooks 22*a* after the two snap hooks 22*a* move towards each other is less than the distance between the two buckles 12, so that the snap hooks 22*a* can easily engage with or be disengaged from the buckles 12.

Referring to FIG. 2, an end of each pressing member 24 close to one movable member 22 defines a third accommodation groove 241, which is matched with an end of one movable member 22 away from one elastic member 23. The end of one movable member 22 away from one elastic member 23 is accommodated in the third accommodation groove 241. A surface of each pressing member 24 away from one movable member 22 is arc shaped and matches with a surface of the watch strap 30, so that a surface of each pressing member 24 smoothly connects with a surface of the watch strap 30.

Referring to FIGS. 2 to 6, an end of the watch strap 30 connected with the watch head 10 defines a second groove 33 for installing the locking assembly 20, and the sides of the watch strap 30 in a width direction each define a mounting hole 31 for installing one pressing member 24. The second groove 33 defines a concave area 32 whose profile matches with the first plate 211. The first plate 211 is installed in the concave area 32 to fix the base 21 in the watch strap 30.

When releasing the watch strap 30 from the wristwatch 100, the two pressing members 24 are pressed to drive the movable members 22 to move towards the connecting portion 211*a*, the movable members 22 compress the elastic members 23 to move towards the connecting member 211*a*, causing the two movable members 22 to disengage the two snap hooks 22*a* from the two buckles 12, and then the wristwatch can be taken off. When putting the wristwatch 100 on again, the two pressing members 24 are pressed to cause the two movable members 22 to move towards each other, and then an end of the watch strap 30 is placed in the first groove 11, and then the pressure on the two pressing members 24 is released, the movable members 22 are moved to original positions by the elastic members 23, and the two snap hooks 22*a* engage with the buckles 12, to secure the watch strap 30 to the watch head 10.

The watch strap 30 is installed on or disassembled from the watch head 10 merely by pressing the two pressing members 24, without removing the entire wristwatch 100 from a user's hand, facilitating the replacement of the watch strap 30.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims.

What is claimed is:

1. A strap assembly comprising:

a watch strap defining a groove and two mounting holes;

a base disposed in the groove and extending along a width direction of the watch strap, the base comprising a connecting portion located at a midpoint;

two movable members movably disposed on the base and located on opposite sides of the connecting portion in the width direction of the watch strap;

two snap hooks disposed on respective ends of the two movable members facing the connecting portion;

two elastic members, each of the two elastic members being disposed between one of the two movable members and the connecting portion; and two pressing members disposed on respective ends of the two movable members away from the connecting portion and accommodated in the respective two mounting holes, wherein when the two pressing members are pressed, the two movable members are moved towards each other to compress the two elastic members;

when the two pressing members are released, the two movable members move away from each other by a restoring force of the two elastic members;

the connecting portion defines two first accommodation grooves, an end of each of the two movable members away from one of the two pressing members defines a second accommodation groove, both ends of each of the two elastic members are accommodated in one of the two first accommodation grooves and the second accommodation groove.

2. The wristwatch of claim 1, wherein a surface of each of the two pressing members away from one of the two movable members is arc shaped and matches with a surface of the watch strap.

3. The wristwatch of claim 1, wherein the base further comprising a flange extending along the width direction of the watch strap, each of the two movable members defines a recess whose profile matches with the flange, the flange is slidably accommodated in the recess.

4. The wristwatch of claim 1, wherein each of the two pressing members defines an accommodation groove, an end of each of the two movable members away from one of the two elastic members is accommodated in the accommodation groove.

5. The wristwatch of claim 1, wherein the strap assembly further comprises a cover plate disposed on the base, the cover plate resists against the two movable members to limit a moving direction of the two movable members.

6. The wristwatch of claim 1, wherein the base further comprises a first plate and a second plate vertically connected to the first plate, the connecting portion is disposed on the first plate, the second plate defines two openings, the two snap hooks are movably disposed in the two openings respectively and protrude out of the second plate.

7. The wristwatch of claim 6, wherein the groove defines a concave area matched in profile with the first plate, the first plate is installed in the concave area.

8. A wristwatch comprising:

a watch head defining a first groove;

two buckles disposed in the first groove;

a strap assembly comprising:

a watch strap defining a second groove and two mounting holes, an end of the watch strap being adapted to be accommodated in the first groove;

a base disposed in the second groove and extending along a width direction of the watch strap, the base comprising a connecting portion located at a midpoint;

two movable members movably disposed on the base and located on opposite sides of the connecting portion in the with direction of the watch strap;

two snap hooks disposed on respective ends of the two movable members facing the connecting portion, the two snap hooks being adapted for engagement with or disengagement from the respective two buckles;

two elastic members, each of the two elastic members being disposed between one of the two movable members and the connecting portion; and two pressing members disposed on respective ends of the two movable members away from the connecting portion and installed in the respective two mounting holes, wherein when the two pressing members are pressed, the two movable members are moved towards each other, to compress the two elastic members, and to cause the two snap hooks to become disengaged from the two buckles;

when the two pressing members are released, the two movable members move away from each other by a restoring force of the two elastic members, to cause the two snap hooks to become engaged with the two buckles;

the connecting portion defines two first accommodation grooves, an end of each of the two movable members away from one of the two pressing members defines a second accommodation groove, both ends of each of the two elastic members are accommodated in one of the two first accommodation grooves and the second accommodation groove.

9. The wristwatch of claim 8, wherein a surface of each of the two pressing members away from one of the two movable members is arc shaped and matches with a surface of the watch strap.

10. The wristwatch of claim 8, wherein the base further comprising a flange extending along the width direction of the watch strap, each of the two movable member defines a recess matched with the flange, the flange is slidably accommodated in the recess.

11. The wristwatch of claim 8, wherein each of the two pressing members defines an accommodation groove, an end of each of the two movable members away from one of the two elastic members is accommodated in the accommodation groove.

12. The wristwatch of claim 8, wherein the strap assembly further comprises a cover plate disposed on the base, the cover plate resists against the two movable members to limit a moving direction of the two movable members.

13. The wristwatch of claim 8, wherein the base further comprises a first plate and a second plate vertically connected to the first plate, the connecting portion is disposed on the first plate, the second plate defines two openings, the two snap hooks are movably disposed in the two openings respectively and protrude out of the second plate.

14. The wristwatch of claim 13, wherein the second groove defines a concave area matched in profile with the first plate, the first plate is installed in the concave area.

15. The wristwatch of claim 8, wherein each of the two buckles defines a slot configured for engaging with or disengaging from one of the two snap hooks.

* * * * *